US007341291B2

(12) United States Patent
Ooe et al.

(10) Patent No.: US 7,341,291 B2
(45) Date of Patent: Mar. 11, 2008

(54) DOOR HANDLE DEVICE FOR VEHICLE

(75) Inventors: Kouji Ooe, Nagoya (JP); Hiroshi Ishihara, Anjo (JP); Yoshikatsu Furuya, Toyota (JP); Takayuki Miyahara, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 84 days.

(21) Appl. No.: 11/080,512

(22) Filed: Mar. 16, 2005

(65) Prior Publication Data

US 2005/0206176 A1 Sep. 22, 2005

(30) Foreign Application Priority Data

Mar. 17, 2004 (JP) ..... 2004-076916

(51) Int. Cl.
*E05B 3/00* (2006.01)

(52) U.S. Cl. ..... 292/336.3; 292/DIG. 22

(58) Field of Classification Search ..... 292/336.3, 292/347, DIG. 22; 296/155
See application file for complete search history.

(56) References Cited

U.S. PATENT DOCUMENTS 5,234,237 A * 8/1993 Gergoe et al. ..... 292/201
5,769,471 A * 6/1998 Suzuki et al. ..... 292/336.3
5,836,639 A * 11/1998 Kleefeldt et al. ..... 296/155
5,979,949 A * 11/1999 Finkelstein et al. ..... 292/29
6,099,052 A * 8/2000 Spitzley ..... 292/336.3
6,719,336 B2 * 4/2004 Sato ..... 292/336.3

FOREIGN PATENT DOCUMENTS

JP 47-40914 12/1972
JP 9-72141 A 3/1997
JP 2002-13320 A 1/2002

OTHER PUBLICATIONS

Japanese Office Action dated Dec. 5, 2006 issued in Japanese Patent Application No. 2004-076916.
Translation of Japanese Office Action dated Dec. 5, 2006 issued in Japanese Patent Application No. 2004-076916.

* cited by examiner

*Primary Examiner*—Gary Estremsky
(74) *Attorney, Agent, or Firm*—Buchanan Ingersole & Rooney PC

(57) ABSTRACT

A door handle device for vehicle rotatably supported by a vehicle door includes a handle portion extended in a first radial direction relative to a rotational axis and positioned outside the vehicle door, a lever portion extended in a second radial direction relative to the rotational axis and positioned in the vehicle door, the lever portion being connected to a connection member for transmitting operational force of door lock release to a door lock mechanism, and a counter-weight provided at the handle portion.

5 Claims, 2 Drawing Sheets

DOOR HANDLE DEVICE FOR VEHICLE

CROSS REFERENCE TO RELATED APPLICATIONS

This application is based on and claims priority under 35 U.S.C. §119 with respect to Japanese Patent Application No. 2004-076916 filed on Mar. 17, 2004, the entire content of which is incorporated herein by reference.

FIELD OF THE INVENTION

The present invention relates to a door handle device for vehicle.

BACKGROUND

A known door handle device for vehicle is described in JP2002-13320A. The known door handle device for vehicle described in JP2002-13320A includes a counterweight in order to prevent a vehicle door from erroneously opening because of unintentional release of a door lock mechanism caused by an impact at vehicle collision.

In case plural door lock mechanisms for locking a vehicle door are provided (e.g., the vehicle door corresponds to a slide door), in order to simultaneously transmit operational force of a handle to the plural door lock mechanisms, the door handle device for vehicle may include an intermediary (i.e., remote controller) for relaying the operational force. In this case, a door handle device for vehicle and the intermediary are connected by means of a connection member with high rigidity, and the operational force of the handle is simultaneously transmitted to the door lock mechanism via the intermediary.

With the construction of the known door handle device for vehicle described in JP2002-13320A, a vehicle door may be erroneously opened because of release of the door lock mechanism by means of the moment of force generated by inertia of the connection member when the vehicle collides. A countermeasure against the erroneous opening of the vehicle door is desired.

A need thus exists for a door handle device for vehicle which prevents erroneous opening of a vehicle door when a vehicle collides without undermining assembling performance.

SUMMARY OF THE INVENTION

In light of the foregoing, the present invention provides a door handle device for vehicle rotatably supported by a vehicle door, which includes a handle portion extended in a first radial direction relative to a rotational axis and positioned outside the vehicle door, a lever portion extended in a second radial direction relative to the rotational axis and positioned in the vehicle door, the lever portion being connected to a connection member for transmitting operational force of door lock release to a door lock mechanism, and a counterweight provided at the handle portion.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

One embodiment of the present invention will be explained with reference to illustrations of drawing figures as follows.

Figure 4:
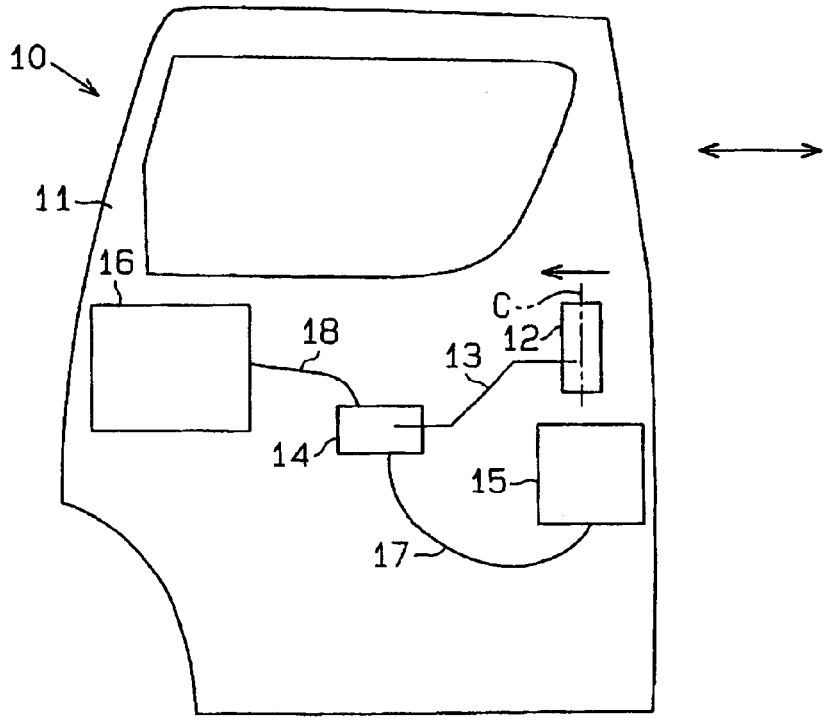
FIG. 4 is an overview showing a slide door system according to the embodiment of the present invention.

FIG. 4 shows an overview of a slide door system of a vehicle on which the embodiment of the present invention is applied. For the explanatory purpose, a slide door system positioned on the right side as one faces the front of vehicle is shown. Constructions of a slide door system positioned on the left side as one faces of the front of vehicle is likewise the slide door system positioned on the right side except that parts are arranged symmetrically relative to the slide door system position on the right side of the vehicle. As shown in FIG. 4, a slide door system 10 includes a slide door 11 serving as a vehicle door, an outside handle 12, a connection member 13, a remote controller 14, a front lock 15 serving as a door lock mechanism, and a rear lock 16 serving as the door lock mechanism.

The slide door 11 opens and closes an opening portion provided on a lateral surface of a vehicle body by moving (i.e., sliding) in a longitudinal direction (i.e., right-left direction of FIG. 4) of the vehicle. The outside handle 12 is supported rotatably about a rotational axis C at a predetermined position closer to front side of the vehicle relative to the slide door 11. The outside handle 12 is positioned to extend in a top-bottom direction of the slide door 11 (i.e., top-bottom direction of FIG. 4). Operation of the outside handle 12 moving from a front side (i.e., in FIG. 3 as seen from near side which is perpendicular to surface of FIG. 3) to farside (i.e., left side of FIG. 4) corresponds to the operation for releasing (i.e., unlocking) a door lock.

The outside handle 12 is connected to the connection member 13. The connection member 13 made from structural material with rigidity such as metal bar is positioned to extend in a longitudinal direction (i.e., right-left direction of FIG. 4) of the slide door 11 from the outside handle 12. That is, the connection member 13 is extended from the outside handle 12 to the rear side of the slide door 11 so that a tip of the connection member 13 is connected to the remote controller 14. The connection member 13 operates to pull the tip of the connection member 13 back to the front side of the slide door 11 when the outside handle 12 is operated to release the door lock.

The remote controller 14 is positioned at a central portion of the slide door 11, and is connected to the front lock 15 and the rear lock 16 via connection cables 17, 18 respectively. The front lock 15 and the rear lock 16 includes known lock mechanisms including a latch and a pawl, and locks a front portion and a rear portion of the slide door 11 respectively by engaging with the vehicle body. The remote controller 14 releases the front lock 15 and the rear lock 16 via the connection cables 17, 18 respectively by pulling the connection member 13 back to the front side, and thus to unlock the front portion and the rear portion of the slide door 11.

In other words, when the outside door handle 12 is operated in the foregoing manner to release the door lock, the operational force is transmitted to the remote controller 14 via the connection member 13, and is further transmitted to the front lock 15 and the rear lock 16 via the connection cables 17, 18 respectively. Accordingly, the front lock 15 and the rear lock 16 are released, and the slide door 11 thus becomes cable of being opened.

The connection member 13 weighs relatively large because the connection member 13 is extended to the central portion of the slide door 11 and connected to the remote controller 14.

The construction of the outside door handle 12 will be explained as follows. The line II-II of FIG. 1 is determined so that the rotational axis C is positioned on a cross section taken on line II-II.

Figure 1:
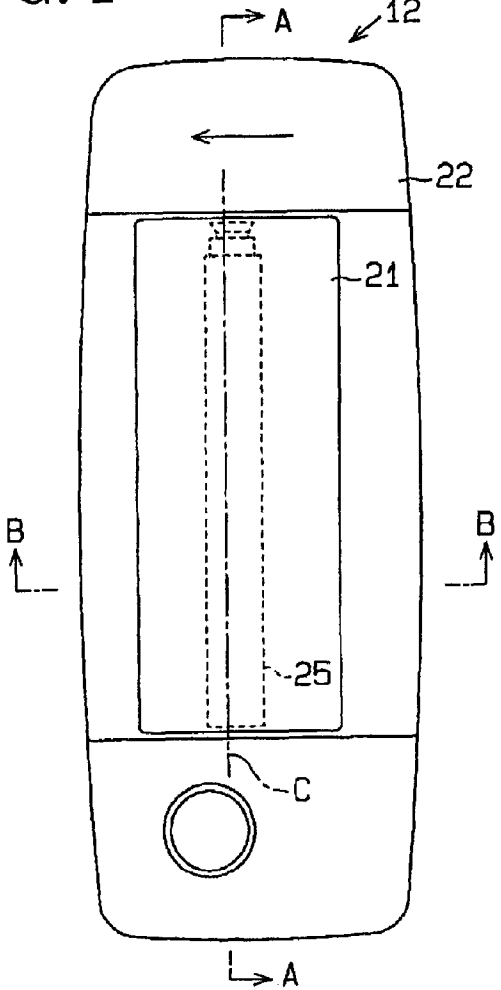
FIG. 1 is a front view showing an outside handle according to an embodiment of the present invention.

As shown in FIG. 1, the outside handle 12 includes a handle body 21 and a handle case 22. The handle case 22 is fixed at a door outer panel of the slide door 11. The handle body 21 is supported rotatably relative to the handle case 22. Thus, the handle body 21 is supported rotatably at the rotational axis C relative to the slide door 11 via the handle case 22 by fixing the handle case 22 to the door outer panel of the slide door 11.

Figure 3:
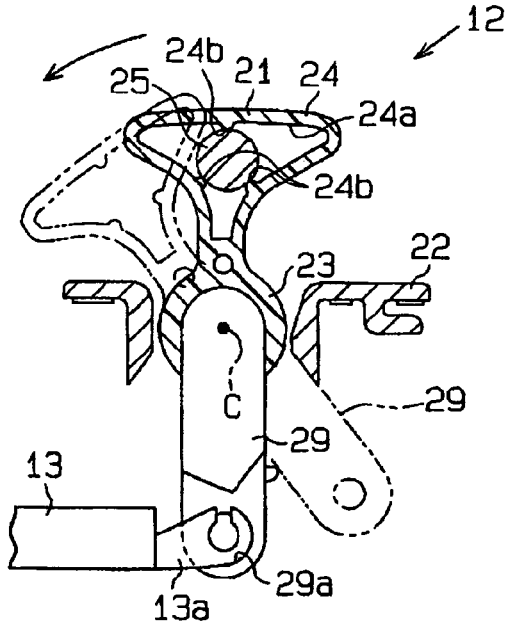
FIG. 3 is a cross-sectional view showing the outside handle taken on line III-III of FIG. 1 according to the embodiment of the present invention.

As shown in FIG. 3, the handle body 21 includes a shaft portion 23 having an arc shaped cross section. A cross section of the shaft portion 23 is configured to remain closed in a radial direction at a first side (i.e., top side of FIG. 3 corresponding to outside of the slide door 11) and to open in a radial direction at a second side (i.e., bottom side of FIG. 3 corresponding to inside of the slide door 11), and is formed along a longitudinal direction of the handle body 21.

The handle body 21 includes a handle portion 24 projected in a radial direction to a first side (i.e., top side of FIG. 3) from peripheral central portion of the shaft portion 23. The handle portion 24 is exposed to outside of the slide door 11 to form design. The handle portion 24 includes a T-shaped cross section in which a tip end is projected to both sides in peripheral direction. The handle portion 24 includes an accommodation concave portion 24*a* having T-shape along an external wall surface. Plural (e.g., three according to the embodiment of the present invention) projected wall portions 24*b* projected towards the center of the outside handle 12 are formed on an internal wall surface of the accommodation concave portion 24*a*. The projected wall portions 24*b* are extended in a longitudinal direction of the handle portion 24 in parallel to an axial line of the shaft portion 23. A supporting wall portion 24*c* extended from the internal wall surface to the shaft portion 23 side is formed at a limit of a first side of the accommodation concave portion 24*a* (i.e., lop side of FIG. 2). The supporting wall portion 24*c* includes a circular opening at a central portion thereof.

A counterweight 25 made of metal such as stainless is accommodated in the accommodation concave portion 24*a* of the handle portion 24. The counterweight 25 is formed into a cylinder shape having a diameter slightly larger than a diameter of a circle depicted by three-point method taking tips of the projected wall portions 24*b*. A diameter of a first end (i.e., top side of FIG. 2) is reduced stepwise at reduced diameter portions 25*a*, 25*b*. External peripheral surface of the counterweight 25 is adhered to the projected wall portions 24*b* by means of pressure, and the reduced diameter portion 25*a* is provided at an opening portion of the supporting wall portion 24*c* to accommodate the counterweight 25 in the accommodation concave portion 24*a*. The reduced diameter portion 25*b* penetrating through the supporting wall portion 24*c* is staked while a washer plate 26 engaged at the supporting wall portion 24*c* is attached thereto. Accordingly, the counterweight 25 is prevented from being pulled out relative to the handle portion 24.

The handle body 21 includes supporting wall portions 27, 28 extended in a radial direction to a second side (i.e., left side of FIG. 2 corresponding to inside of the slide door 11) from peripheral central portion of end portions in a longitudinal direction of the shaft portion 23. The supporting wall portions 27, 28 are formed with shaft inserting bores 27*a*, 28*a* provided coaxially with the shaft portion 23 respectively.

Further, the handle body 21 includes a lever portion 29 extended from peripheral central portion of the shaft portion 23 to a second side (i.e., left of FIG. 2 and bottom of FIG. 3 corresponding to inside of the slide door 11) between the supporting wall portions 27, 28. A handle side connection portion 29*a* is formed at a tip of the lever portion 29. The handle side connection portion 29*a* is positioned at opposite side of the counterweight 25 relative to an axial line of the shaft portion 23 (i.e., the shift insertion bores 27*a*, 28*a*). As shown in FIG. 3, a connection portion 13*a* provided at a tip of the connection member 13 is rotatably connected to the handle side connection portion 29*a*. The connection member 13 is extended in a first side from the connection portion 13*a*. Accordingly, by rotating the handle portion 24 of the outside handle 12 counterclockwise to move to the rear side (i.e., left of FIG. 3), the connection member 13 operates to pull the tip thereof to the front side of the slide door 11. In this case, the operation to the handle portion 24 corresponds to the operation for releasing the door lock.

The handle body 21 includes a projection 30 extended in a radial direction (i.e., left side of FIG. 2 corresponding to inside of the slide door 11) from peripheral central portion of the shaft portion 23 between the supporting wall portion 27 and the lever portion 29.

The handle case 22 is configured into a frame shape having an opening for positioning the supporting wall portions 27, 28 of the handle body 21 by insertion. Supporting wall portions 31, 32 extended in a left direction of FIG. 2 corresponding to inside of the slide door 11 are provided at ends of the handle case 22 in a longitudinal direction respectively. Bearing pins 31*a*, 32*a* projected to face each other in a longitudinal direction are formed at the supporting wall portions 31, 32 respectively. The handle body 21 is supported rotatabley relative to the handle case 22 by fitting the bearing-pins 31*a*, 32*a* into the shaft inserting bores 27*a*, 28*a* respectively. A rotational axis of the handle body 21 when the handle case 22 is fixed at the slide door 11 corresponds to the rotational axis C.

Figure 2:
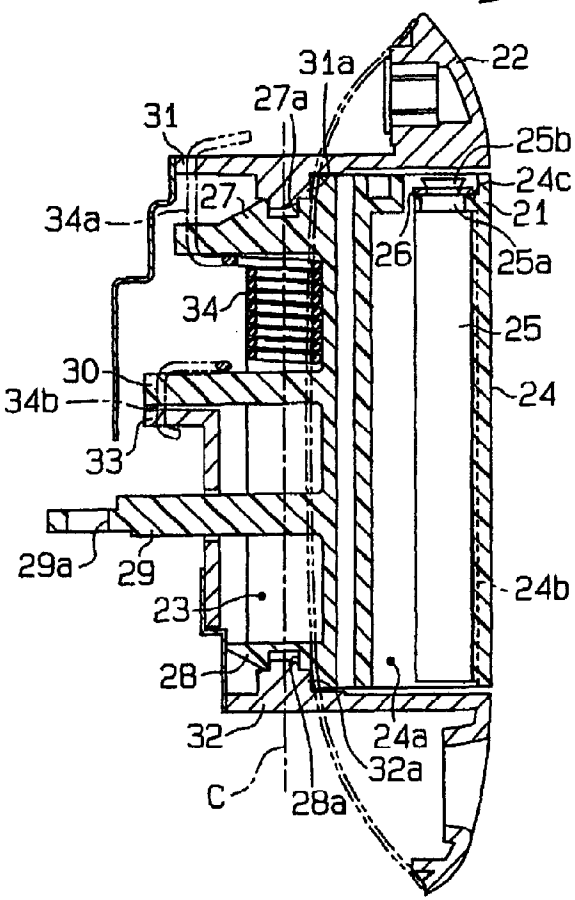
FIG. 2 is a cross-sectional view showing the outside handle taken on line II-II of FIG. 1 according to the embodiment of the present invention.

The handle case 22 includes a projection 33 extended in a left direction of FIG. 2. The projection 33 and the supporting wall portion 31 are arranged to sandwich the supporting wall portion 27 and the projection 30. A helical coil spring 34 is provided coaxially with the shaft portion 23 between the supporting wall portion 27 and the projection 30 of the handle body 21. A first end 34*a* of the helical coil spring 34 contacts the supporting wall portions 27, 31 by means of pressure. A second end 34*b* of the helical coil spring 34 contacts the projection portions 30, 33 by means of pressure. The helical coil spring 34 biases the supporting wall portions 27, 31 in a first direction (i.e., in FIG. 2 as seen from the farside) via the first end 34*a* and biases the projected wall portions 30, 33 in a second direction (i.e., in FIG. 2 as seen from a front side) to maintain the handle body 21 at neutral position when the outside handle 12 is not operated. Otherwise, the helical coil spring 34 returns the handle body 21 to the neutral position when the operational force to the handle body 21 is released. The neutral position of the handle body 21 corresponds to position at which operational force for releasing the door lock, or the like, does not act on (i.e., corresponds to position shown with solid line of FIG. 3).

Operation of the handle body 21 will be explained as follows. When the handle body 21 is supported by the handle case 22 fixed at the slide door 11, the handle portion 24 is extended in a radial direction to a first side relative to the rotational axis C to be positioned outside the slide door 11. In this case, the lever portion 29 connected to the connection member 13 is extended in a radial direction to a second side relative to the rotational axis C to be positioned in the slide door 11. Thus, the handle portion 24 and the lever portion 29 are extended in opposite radial directions relative to the rotational axis C. The counterweight 25 is provided at the handle portion 24. Accordingly, for example, when the vehicle collides, the moment of force generated at the lever portion 29 by inertia of the connection member 13 and the moment of force generated at handle portion 24 by inertia of the counterweight 25 cancel each other. Accordingly, erroneous opening of the slide door 11 by transmission of operational force for releasing the door lock from the connection member 13 to the front lock 15 and the rear lock 16 via the remote controller 14 caused by an impact when the vehicle collides is prevented.

According to the embodiment of the present invention, the erroneous opening of the slide door 11 by transmission of operational force of the door lock release from the connection member 13 to the front lock 15 and the rear lock 16 via the remote controller 14, or the like, caused by an impact when the vehicle collides can be prevented.

Particularly, by providing the counterweight 25 at the handle portion 24 positioned outside the slide door 11, the assembling performance of the handle body 21 (outside handle 12) can be improved compared to a case, for example, the counterweight 25 is provided inside the slide door 11. Further, compared to a case that the counter weight is accommodated in the slide door, with the construction, of the embodiment of the present invention, accommodation space which should be ensured inside the slide door 11 can be reduced.

According to the embodiment of the present invention, by accommodating the counterweight 25 in the handle portion 24, the counterweight 25 is not exposed to the outside of the slide door 11 and does not influence the design, which improves appearance of the slide door 11. Further, the size of the slide door 11 can be restrained compared to a case that the counterweight is externally provided on the handle portion 24.

According to the embodiment of the present invention, the counterweight 25 is accommodated in the accommodation concave portion 24*a* with restrained shakiness by being adhered to the projected portion 24 by means of pressure.

According to the embodiment of the present invention, the counterweight 25 is prevented to be pulled out relative to the handle portion 24 by staking the reduced diameter portion 25*b* penetrating through the supporting wall portion 24*c* while the washer plate 26 is attached to the reduced diameter portion 25*b*.

According to the embodiment of the present invention, the handle portion 24 is arranged so that the rotational axis C is extended in a top-bottom direction of the slide door 11, and the connection member 13 is positioned to extend in back and forth direction of the slide door 11. Thus, mainly when the vehicle collides headed-on (i.e., including rear end collision), the moment of force generated at the lever portion 29 by inertia of the connection member 13 and the moment of force generated at the handle portion 24 by inertia of the counterweight 25 cancel each other. Accordingly, the erroneous opening of the slide door 11 can be prevented particularly when the vehicle collides headed-on. However, even when the vehicle collides from a lateral direction, the moment of force generated at the lever portion 29 by a component of inertia of the connection member 13 and the moment of force generated at the handle position by a component of inertia of the counterweight 25 cancel each other. Accordingly, the erroneous opening of the slide door 11 caused by an impact when the vehicle collides from the lateral direction can be prevented.

The construction of the door handle device according to the embodiment of the present invention may be varied as follows. It is not required to accommodate the counterweight 25 in the handle portion 24. Instead, for example, a part of the counterweight 25 may be embedded into the handle portion 24.

Positioning of the remote controller 14, or the like, in the slide door 11 is not limited, and may be varied. Connecting construction for transmitting operational force for unlocking-the door lock from the connection member 13 is not limited and may be varied. The handle body 21 may include pull-up type for unlocking the door lock by being rotated to be pulled upward as long as the-handle body 21 is supported rotatably relative to the vehicle door.

The embodiment of the present invention may be applied to a handle body of an inside handle. The outside of the vehicle door according to the embodiment of the present invention is defined as a side which exposed to outside (i.e., not inside), and is differentiated from outside of the vehicle per se.

According to the embodiment of the present invention, the vehicle door may include a swing door.

According to the embodiment of the present invention, the handle portion is extended in the radial direction at the first side relative to the rotational shaft and outside the vehicle door, and the lever portion connected to the connection member is extended in the radial direction at the second side relative to the rotational shaft and positioned in the vehicle door. The counterweight is provided at the handle portion. Thus, for example, when the vehicle collides, the moment of force generated at the lever portion by inertia of the connection member and the moment of force generated at the handle portion by inertia of the counterweight cancel each other. Accordingly, erroneous opening of the vehicle door by transmission of operational force of door lock release from the connection member to the door lock mechanism caused by an impact when the vehicle collides can be prevented. Particularly, by providing the counterweight at the handle portion positioned outside the vehicle door, the assembling performance of the door handle device can be improved compared to a case that the counterweight is positioned in the vehicle door.

According to the embodiment of the present invention, by providing the counterweight inside the handle portion, the appearance can be improved because the counterweight is not exposed to outside the vehicle door serving as a design surface.

According to the embodiment of the present invention, the counterweight is accommodated in the accommodation concave portion while restraining shakiness by adhering the counterweight to the projected wall portion by pressure.

The principles, preferred embodiment and mode of operation of the present invention have been described in the foregoing specification. However, the invention which is intended to be protected is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door handle device mounted on an outside of a vehicle door comprising:

a handle portion rotatably supported on the outside of the vehicle door for rotation about a rotational axis upon application of an operational force to the handle portion, the handle portion extending in a first radial direction relative to the rotational axis;

a lever portion extending in a second radial direction relative to the rotational axis and connected to a connection member for transmitting the operational force applied to the handle portion to result in release of a door lock mechanism;

a counterweight provided inside the handle portion;

wherein the handle portion includes an accommodation concave portion provided with a projected wall portion extending in a longitudinal direction; and the counterweight is accommodated in the accommodation concave portion and adhered to the projected wall portion by pressure.

2. The door handle device mounted on an outside of a vehicle door according to claim 1, wherein the connection member is connected to a remote controller which controls release of the door lock mechanism.

3. The door handle device mounted on the outside of the vehicle door according to claim 1, wherein the connection member is connected to a remote controller which controls release of the door lock mechanism and another door lock mechanism.

4. The door handle device mounted on the outside of the vehicle door according to claim 2, wherein the handle portion comprises a rotational shaft extending in a top-bottom direction of the vehicle door; and the connection member extends in a back and forth direction of the vehicle door.

5. The door handle device mounted on the outside of the vehicle door according to claim 1, wherein the handle portion comprises a rotational shaft adapted to extend in a top-bottom direction of the vehicle door; and the connection member is adapted to extend in a back and forth direction of the vehicle door.

* * * * *